US011179618B2

(12) United States Patent
Moritz et al.

(10) Patent No.: US 11,179,618 B2
(45) Date of Patent: Nov. 23, 2021

(54) SYSTEMS AND METHODS FOR GUIDING USER CONTROL OF FITNESS MACHINES

(71) Applicant: Life Fitness, LLC, Rosemont, IL (US)

(72) Inventors: Christina M. Moritz, Des Plaines, IL (US); Mercedes R. Masias, Chicago, IL (US); Cory H. Lazar, Chicago, IL (US)

( * ) Notice: Subject to any disclaimer, the term of this patent is extended or adjusted under 35 U.S.C. 154(b) by 150 days.

(21) Appl. No.: 16/572,792

(22) Filed: Sep. 17, 2019

(65) Prior Publication Data

US 2021/0077887 A1 Mar. 18, 2021

(51) Int. Cl.
*A63B 71/06* (2006.01)
*A63B 22/02* (2006.01)
*A63B 24/00* (2006.01)

(52) U.S. Cl.
CPC ..... *A63B 71/0622* (2013.01); *A63B 22/025* (2015.10); *A63B 24/0087* (2013.01);
(Continued)

(58) Field of Classification Search
CPC ..... A63B 22/0015; A63B 22/0023; A63B 22/0076; A63B 22/02; A63B 22/0235; A63B 22/0242; A63B 22/025; A63B 22/0605; A63B 22/0664; A63B 24/0062; A63B 24/0075; A63B 24/0087; A63B 2024/0065; A63B 2024/0068; A63B 2024/0093; A63B 71/0619; A63B 71/0622; A63B 71/0686; A63B 2071/065;
(Continued)

(56) References Cited

U.S. PATENT DOCUMENTS 4,358,105 A * 11/1982 Sweeney, Jr. ..... A63B 24/00 482/5
5,067,710 A * 11/1991 Watterson ..... A63B 21/026 482/3

(Continued)

OTHER PUBLICATIONS

Allen, Hunter et al. Training and Racing with a Power Meter. Third Edition. Boulder, CO: Velo Press; 2019, pp. 11-38.

(Continued)

*Primary Examiner* — Gary D Urbiel Goldner
(74) *Attorney, Agent, or Firm* — Andrus Intellectual Property Law, LLP

(57) ABSTRACT

A method for controlling a fitness machine by a user, where the method includes storing intensity ratings within a memory device, and the intensity ratings correspond to an intensity for the user operating the fitness machine. The method includes displaying initial operating levels selectable to control the fitness machine, where the intensity for the user varies for each of the initial operating levels. The method includes determining and displaying the intensity rating associated with each of the initial operating levels, receiving a selection from the initial operating levels and automatically controlling the fitness machine to operate according thereto, displaying, after receiving the selection among the initial operating levels, new operating levels selectable to control the fitness machine, and determining and displaying the intensity ratings associated with each of the new operating levels. At least one of the new operating levels and one of the initial operating levels are different.

19 Claims, 7 Drawing Sheets

(52) U.S. Cl.
CPC . *A63B 2071/065* (2013.01); *A63B 2071/0658* (2013.01); *A63B 2071/0675* (2013.01); *A63B 2071/0694* (2013.01)

(58) Field of Classification Search
CPC .... A63B 2071/0658; A63B 2071/0675; A63B 2071/0694; A63B 2220/80; A63B 2220/83; A63B 2220/836; A63B 2225/50; A63B 2230/04; A63B 2230/06; A63B 2230/062; A63B 2230/065; A63B 2230/067; A63B 2230/08; A63B 2230/085; A63B 2230/75; A63B 2230/755
See application file for complete search history.

(56) References Cited

U.S. PATENT DOCUMENTS 5,318,487 A * 6/1994 Golen ..... A61B 5/222 482/3
5,512,025 A * 4/1996 Dalebout ..... A63B 21/015 482/54
5,645,509 A * 7/1997 Brewer ..... A63B 22/02 379/106.01
5,899,833 A 5/1999 Ryan et al.
6,095,951 A 8/2000 Skowronski et al.
6,099,439 A 8/2000 Ryan et al.
6,458,060 B1 * 10/2002 Watterson ..... A63B 22/0235 482/54
7,060,006 B1 * 6/2006 Watterson ..... A63B 71/0054 482/54
7,115,076 B2 10/2006 Oglesby et al.
8,105,208 B2 1/2012 Oleson et al.
8,200,323 B2 6/2012 Dibenedetto et al.
8,360,936 B2 1/2013 Dibenedetto et al.
8,801,577 B2 8/2014 Dibenedetto et al.
8,855,756 B2 10/2014 Dibenedetto et al.
8,911,329 B2 12/2014 Lin et al.
9,463,356 B2 10/2016 Rhea
9,833,661 B2 12/2017 Fischer
10,166,436 B2 1/2019 Dibenedetto et al.
10,617,331 B1 * 4/2020 Solberg ..... A61B 5/1123
2002/0016235 A1 * 2/2002 Ashby ..... A63B 21/005 482/8
2002/0022551 A1 * 2/2002 Watterson ..... H04L 67/02 482/8
2002/0042328 A1 * 4/2002 Yoo ..... A63B 24/0062 482/8
2002/0045519 A1 * 4/2002 Watterson ..... A63B 22/0023 482/54
2004/0171956 A1 9/2004 Babashan
2007/0042868 A1 * 2/2007 Fisher ..... B62D 1/02 482/8
2007/0149364 A1 * 6/2007 Blau ..... A63B 21/0053 482/57
2007/0265138 A1 * 11/2007 Ashby ..... H04L 67/20 482/8
2008/0009393 A1 * 1/2008 Glusco ..... A61B 5/0245 482/8
2009/0011907 A1 * 1/2009 Radow ..... A63B 24/0084 482/57
2010/0022354 A1 * 1/2010 Fisher ..... A63B 24/0087 482/8
2010/0035726 A1 * 2/2010 Fisher ..... A63B 24/0084 482/8
2010/0198453 A1 * 8/2010 Dorogusker ..... A63B 24/0062 701/31.4
2010/0292600 A1 * 11/2010 DiBenedetto ..... A61B 5/024 600/520
2010/0304932 A1 * 12/2010 Kolman ..... A63B 71/0619 482/7
2011/0071003 A1 * 3/2011 Watterson ..... H04L 67/12 482/8
2011/0319229 A1 * 12/2011 Corbalis ..... A63B 71/0622 482/9
2012/0264569 A1 * 10/2012 Escobedo ..... A63B 22/025 482/5
2013/0040272 A1 2/2013 Booher
2013/0123071 A1 * 5/2013 Rhea ..... A63B 24/0087 482/8
2013/0137073 A1 5/2013 Nacey et al.
2013/0210579 A1 * 8/2013 Schieffer ..... A63B 71/0622 482/8
2013/0225370 A1 * 8/2013 Flynt ..... A63B 71/0622 482/4
2013/0274067 A1 * 10/2013 Watterson ..... A63B 21/0051 482/5
2014/0113768 A1 * 4/2014 Lin ..... A63B 22/0605 482/5
2014/0194248 A1 * 7/2014 Kolman ..... A63B 71/0622 482/4
2015/0209615 A1 6/2015 Edwards
2015/0238817 A1 8/2015 Watterson et al.
2015/0343264 A1 * 12/2015 Rhea ..... A63B 24/0087 482/4
2016/0240100 A1 8/2016 Rauhala et al.
2017/0266535 A1 * 9/2017 Watterson ..... A63B 22/0242
2017/0340921 A1 11/2017 Fischer
2018/0056132 A1 * 3/2018 Foley ..... A63B 23/1227
2018/0126248 A1 * 5/2018 Dion ..... H04L 65/403
2018/0126249 A1 * 5/2018 Consiglio ..... A63B 22/025
2018/0140903 A1 * 5/2018 Poure ..... A63B 24/0087
2018/0345082 A1 12/2018 Kimura et al.
2019/0126099 A1 * 5/2019 Hoang ..... A63F 13/798
2019/0336827 A1 * 11/2019 Intonato ..... A63B 71/0622
2020/0276475 A1 * 9/2020 Casalini ..... A63B 24/0062

OTHER PUBLICATIONS

Extended European Search Report for corresponding European Patent Application No. 20196346.9 dated Feb. 2, 2021.

* cited by examiner

SYSTEMS AND METHODS FOR GUIDING USER CONTROL OF FITNESS MACHINES

FIELD

The present disclosure generally relates to systems and methods for guiding user control of fitness machines, and more particularly to systems and methods for guiding user control of fitness machines with respect to intensity of operation.

BACKGROUND

The following U.S. patents and patent applications provide background information and are incorporated by reference in entirety.

U.S. Pat. No. 7,115,076 discloses a microprocessor based exercise treadmill control system that includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. Another included feature is the ability to display the amount of time a user spends in a heart rate zone.

U.S. Pat. No. 9,833,661 and U.S. Patent Application Publication No. US2017/0340921 disclose stationary exercise equipment for physical training, more particularly an exercise bike, comprising a frame with a movement unit which either is to be moved by the exerciser or is itself driven and interacts with the exerciser, one or more sensors, assigned to the movement unit and/or the exerciser, for capturing measured values, and a computer apparatus for establishing one or more items of measurement-value-related information, which are output on a frame-side display apparatus, letterized in that provision is made for a first display apparatus, which is directed at the exerciser for displaying one or more items of information, and in that provision is made for a second display apparatus, which is directed at the opposite side for outputting at least one item of information.

Additional patents of interest include U.S. Pat. Nos. 6,099,439; 6,095,951; and 5,899,833.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for controlling a fitness machine by a user, where the method includes storing intensity ratings within a memory device, and the intensity ratings correspond to an intensity for the user operating the fitness machine. The method includes displaying initial operating levels selectable to control the fitness machine, where the intensity for the user varies for each of the initial operating levels. The method includes determining and displaying the intensity rating associated with each of the initial operating levels, receiving a selection from the initial operating levels and automatically controlling the fitness machine to operate according thereto, displaying, after receiving the selection among the initial operating levels, new operating levels selectable to control the fitness machine, and determining and displaying the intensity ratings associated with each of the new operating levels. At least one of the new operating levels and one of the initial operating levels are different.

Another embodiment of the present disclosure generally relates to a method for controlling a fitness machine by a user, where the method includes storing intensity ratings within a memory device, and the intensity ratings correspond to an intensity for the user operating the fitness machine. The method includes displaying first parameter operating levels selectable to control the fitness machine, where the intensity for the user varies for each of the first parameter operating levels. The method includes displaying second parameter operating levels selectable to control the fitness machine, wherein the intensity for the user varies for each of the second parameter operating levels. The method includes determining and displaying the intensity ratings associated with each of the first parameter operating levels and each of the second parameter operating levels, and receiving selections for the first parameter operating levels and the second parameter operating levels and automatically controlling the fitness machine to operating according thereto. Selecting one of the first parameter operating levels changes at least one of the intensity ratings displayed with the second parameter operating levels.

Another embodiment generally relates to a non-transitory medium having instructions thereon that, when executed by a processing device, causes a fitness machine operated by a user to determine intensity ratings corresponding to an intensity for the user operating the fitness machine. The non-transitory medium further causes the fitness machine to display first parameter operating levels selectable by the user, where the processing device causes the fitness machine to operate based on which of the first parameter operating levels is selected and the intensity for the user varies therewith, and where the intensity rating associated with each of the first parameter operating levels is displayed. The non-transitory medium further causes the fitness machine to display second parameter operating levels selectable by the user, where the processing device causes the fitness machine to operate based on which of the second parameter operating levels is selected and the intensity for the user varies therewith, and where the intensity rating associated with each of the second parameter operating levels is displayed. Selecting among the first parameter operating levels changes the intensity rating displayed with at least one of the second parameter operating levels selectable by the user.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

Figure 1:
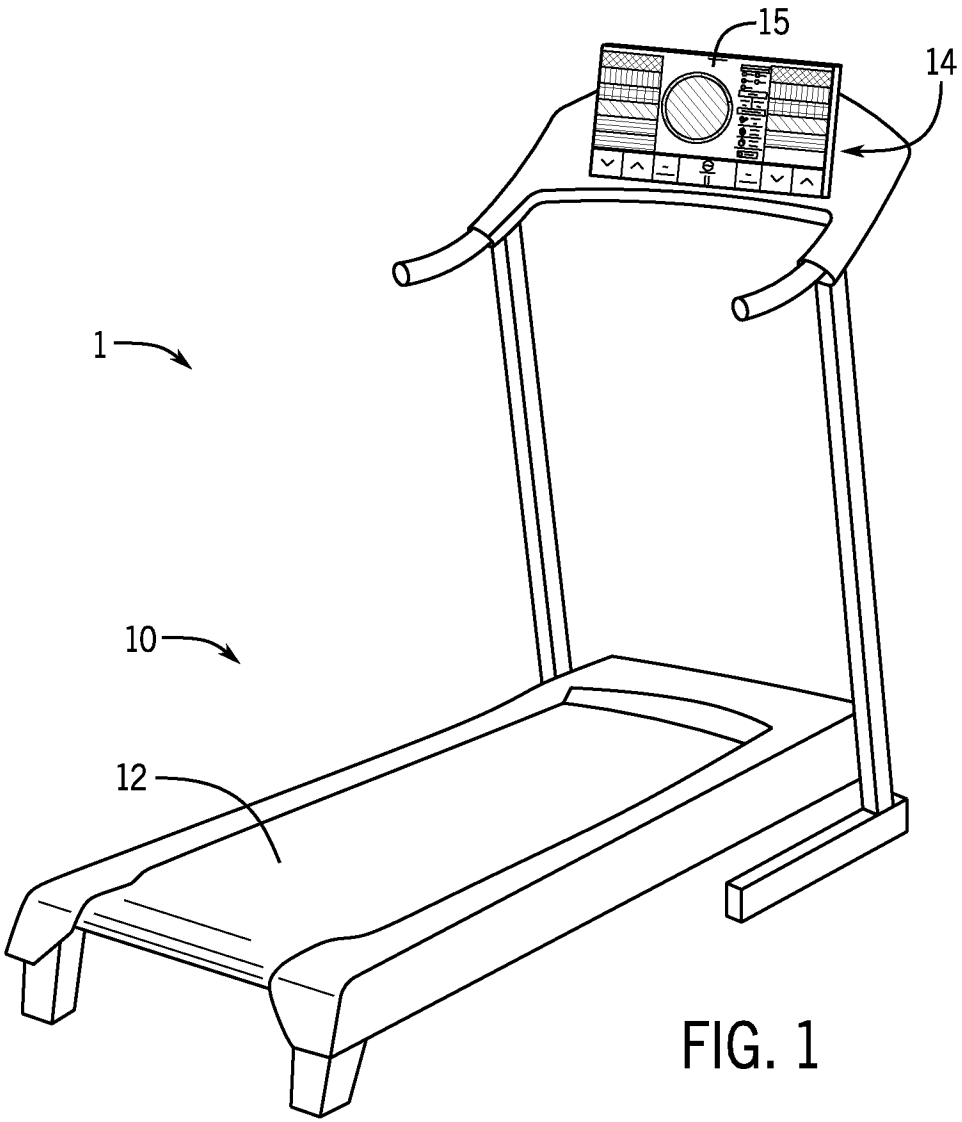
FIG. 1 depicts an exemplary system incorporated into a fitness machine according to the present disclosure.

The present disclosure generally relates to systems and methods for controlling a fitness machine, and particularly for coaching a user thereof with respect to operating the fitness machine. In certain embodiments, the user is coached to achieve a desired intensity from using the fitness machine, which may vary over time according to the user's objectives, programs stored within the fitness machine, and/or at the instruction of a coach in a live or virtual setting.

In certain examples, intensity is measured as a function of the power output of the user in operating the fitness machine, though other measures of intensity may include the user's heartrate, temperature, or other metabolic measures, for example. In one example, the intensity is measured as a function of a user's "functional threshold power" (FTP), which is defined to be the highest power output that a user can maintain for approximately one hour without fatiguing. When the user outputs a power that exceeds their personal FTP, fatigue will occur much sooner than the one-hour benchmark, whereas a power output just below the FTP can be maintained for much longer. Different methods for determining a user's personalized FTP are presently known in the art, including measurements taken over a full sixty-minute period (FTP60), or abbreviated test procedures in which one-hour values are extrapolated from performance over a shorter test period and multiplied by some calculated factor. For example, a five-minute test (FTP5) assumes a 15% reduction in power output would occur if maintained over a one-hour period. Additional information regarding exemplary methods for calculating FTP were introduced and published by Allen, Coggan, and McGregor in the 2019 (Allen H., Coggan A., McGregor S. *Training and Racing with a Power Meter.* 3rd ed. Boulder: Velo Press; 2019).

It should be recognized that the FTP for a particular individual may change over time, particularly as the user improves in fitness level, but will also vary by activity. For example, the intensity maintainable by a user on a bicycle may be different on the street versus in recumbent form, which will each vary from the maximum output producible when running, swimming, and/or while performing other fitness activities. In this manner, the user's intensity may be used to provide coaching for individualized performance during fitness activities, allowing for customized workout plans according to the user's present capabilities. In the context of a class, this also accommodates for different intensity capabilities (such as FTP levels) for each of the participants, which may be greater or less than the FTP level of a coach leading the class.

In addition to recognizing the value in coaching a user and guiding control of a fitness machine according to the intensity of the user, the present inventors have identified an unmet need with respect to providing users with options for achieving such a desired intensity. For example, if the user desires or is instructed to increase the intensity level to a higher intensity rating (i.e., increasing from a level 3 to a level 4, discussed further below), this may be achievable in multiple ways. Moreover, in many circumstances it is acceptable and desirable to enable the user to choose which way to get there. For example, in the context of a treadmill, a user may modify the intensity of operating the treadmill by any one of changing the incline of the treadmill, changing the speed of the treadmill, and/or increasing the resistance provided by the treadmill (for example in a sled-mode operation). However, present systems and methods known in the art only permit coaches to provide specific instructions with respect to each of these parameters (incline, speed, and/or resistance), such as instructing the class to increase the incline to 12%, or increase the speed to 8 miles per hour, for example. While a user could blindly modify settings, there is presently no way to know how the various options would impact the intensity of operation, and also the specific impact on that particular user.

FIG. 1 depicts an exemplary system 1 incorporated within a fitness machine 10 otherwise known in the art, such as a treadmill. In this example, the treadmill incorporates a belt 12 operable in the manner known in the art, along with a display device 14. However, the system 1 provides for particularized control of the fitness machine 10 according to the present disclosure, including through use of a novel interface 15 discussed further below.

Figure 2:
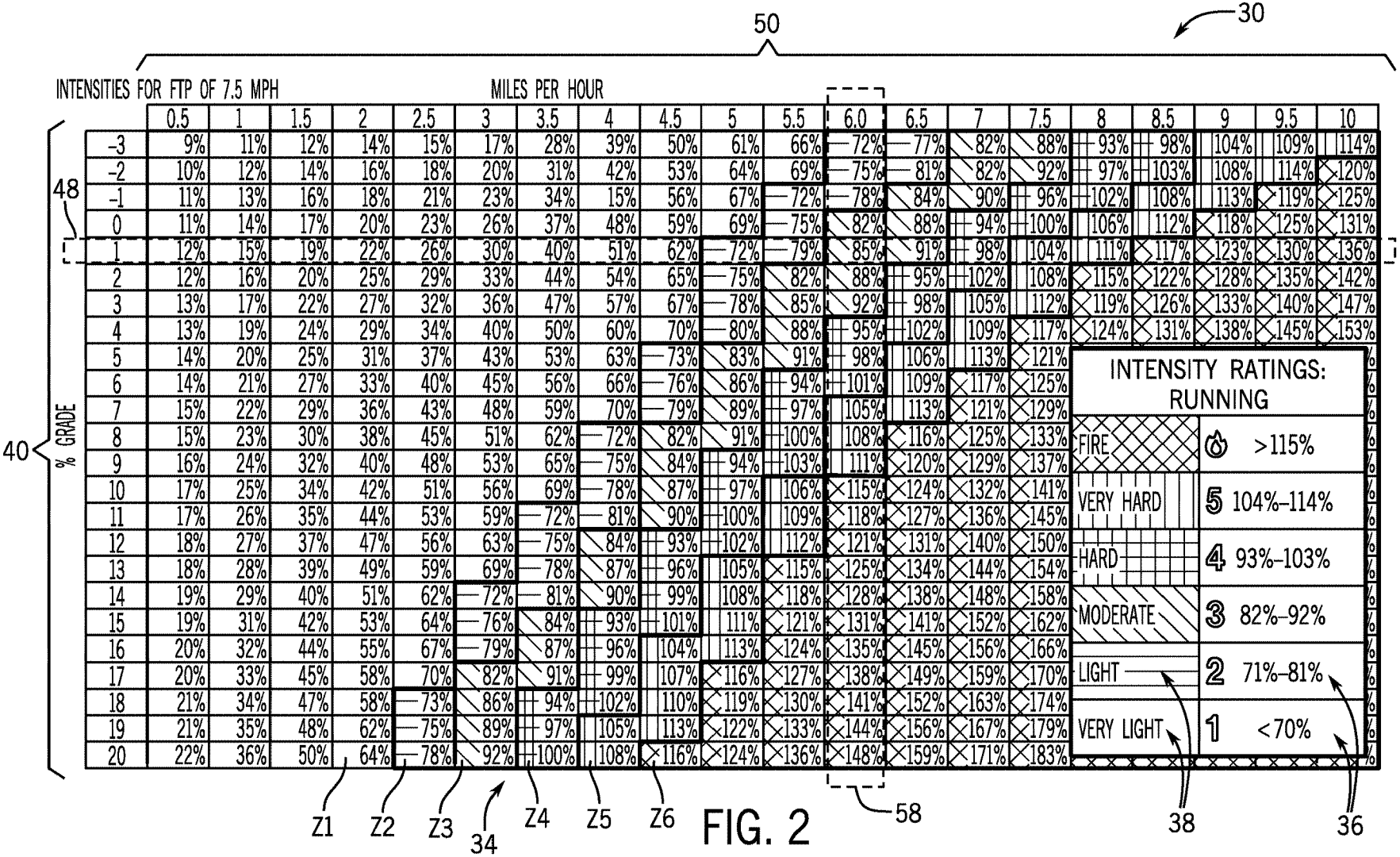
FIG. 2 depicts a system for rating intensities for using a fitness machine.

FIG. 2 depicts exemplary intensity data 30 for a user operating a fitness machine 10, in the present case measuring intensity as FTP (discussed above), and specifically for a user operating a treadmill. The intensity data 30 includes particular intensity values 34 for the user to operate the treadmill 10 based on selections of first parameters 40 and second parameters 50, such as the percent grade or incline of the treadmill, and the speed of the treadmill belt 12, respectively. It should be recognized that greater or fewer parameters may be available for a particular fitness machine 10, as well as different operating conditions assigned to any of the parameters (such as resistance for a recumbent bike, for example). In the embodiment shown, the current value 48 for the first parameter 40 remains constant across a row, and the current value 58 for a second parameter 50 remains constant within a column, whereby the two intersect to provide the user's overall intensity value 34 for operating under those conditions.

The intensity data 30 and particularly the intensity values 34 are further categorized into intensity ratings 36, which include groups of like-valued intensity values 34. In the embodiment shown, there are six intensity ratings 36: 1-5, and "fire" (akin to 6). As shown, zone 1 Z1 corresponds to an intensity rating 34 of less than 70% (of FTP), zone 2 Z2 corresponds to 71%-81%, zone 3 Z3 corresponds to 82%-92%, zone 4 Z4 corresponds to 93%-103%, zone 5 Z5 corresponds to 104%-114%, and fire Z6 corresponds to greater than 115% for intensity values 34.

As will be discussed below, each of the intensity ratings 36 may be further assigned an intensity color 38. In the example shown, zone 1 Z1 has an intensity color 38 of white, zone 2 Z2 of blue, zone 3 Z3 of green, zone 4 Z4 of yellow, zone 5 Z5 of red, and fire Z6 of red/orange/yellow, for example. It should be recognized that alternate intensity colors 38 or other mechanisms for distinguishing between the intensity ratings 36 are also anticipated, such as providing fire Z6 as a darker red, for example. The user will typically not see the intensity data 30 in chart form as shown in FIG. 2, which is stored in a memory system to be discussed below. However, the same intensity values 34, intensity ratings 36, and/or intensity colors 38 are used consistently across the different operating levels corresponding to the first parameter 40, second parameter 50, and/or others such that the user can identify the intensity for the presently operating fitness machine 10 under different settings.

Figure 3:
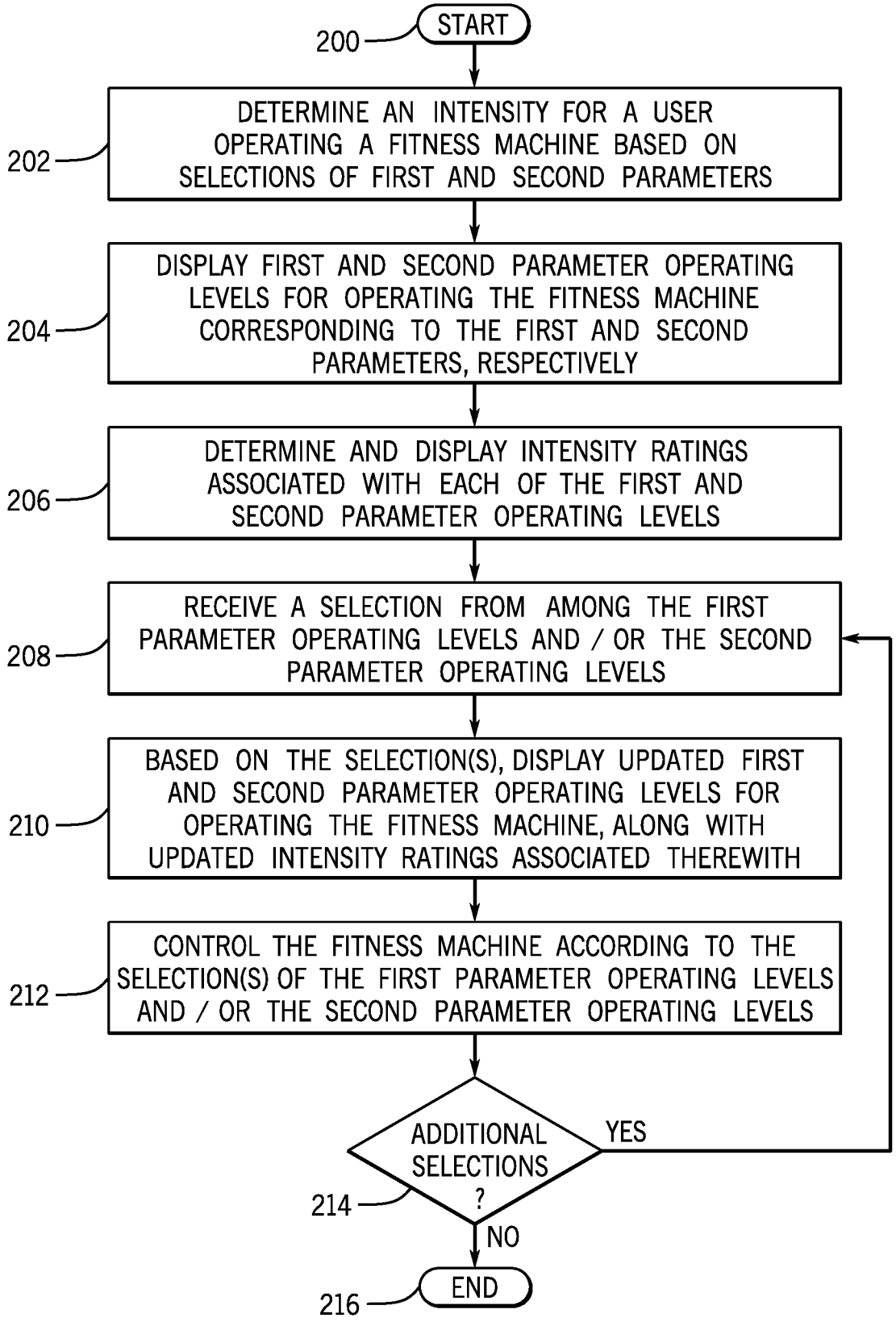
FIG. 3 depicts an exemplary process flow of a method for controlling a fitness machine according to the present disclosure.

FIG. 3 depicts an exemplary method for guiding a user to control a fitness machine 10 according to the present disclosure. Method starts (step 200) by storing intensity ratings 34 within a memory device 184 (discussed below and shown in FIG. 7), wherein the intensity ratings 34 correspond to an intensity for the user operating the fitness machine 10 under particular conditions. This may be based on an internal test mode for determining FTP or another intensity basis, or inputted data, for example. First parameter operating levels 41-46 (FIG. 4) corresponding to the first parameter 40, and second parameter operating levels 51-56 corresponding to the second parameter 50 are displayed in step 204, where the intensity of the user varies with each of the first parameter operating levels 41-46 and likewise for the second parameter operating levels 51-56.

In step 206, intensity ratings 36 are determined and displayed for each of the first parameter operating levels 41-46 and second parameter operating levels 51-56 such that the user can discern the intensity for operating the fitness machine 10 if that particular first parameter operating level 41-46 and/or second parameter operating level 51-56 were selected. The fitness machine 10 then receives a selection in step 208, and based on the selection(s), displays in step 210 updated first parameter operating levels 41-46 and second parameter operating 51-56 for operating the fitness machine 10, along with updated intensity ratings 36 associated therewith. In other words, as a selection is made for one or more of the first parameter operating levels 41-46 and second parameter operating levels 51-56, the available choices are updated, as are the corresponding intensity ratings 36 associated therewith. In step 212, the fitness machine 10 is controlled according to the selections made by the user to effectuate the choices of first parameter 40 and second parameter 50. If additional selections are made in step 214, the process continues by returning to step 208. Alternatively, if no additional selections are made at step 214, the process ends at step 216 until new selections of the first parameter 40 and/or second parameter 50 are made.

Figure 4:
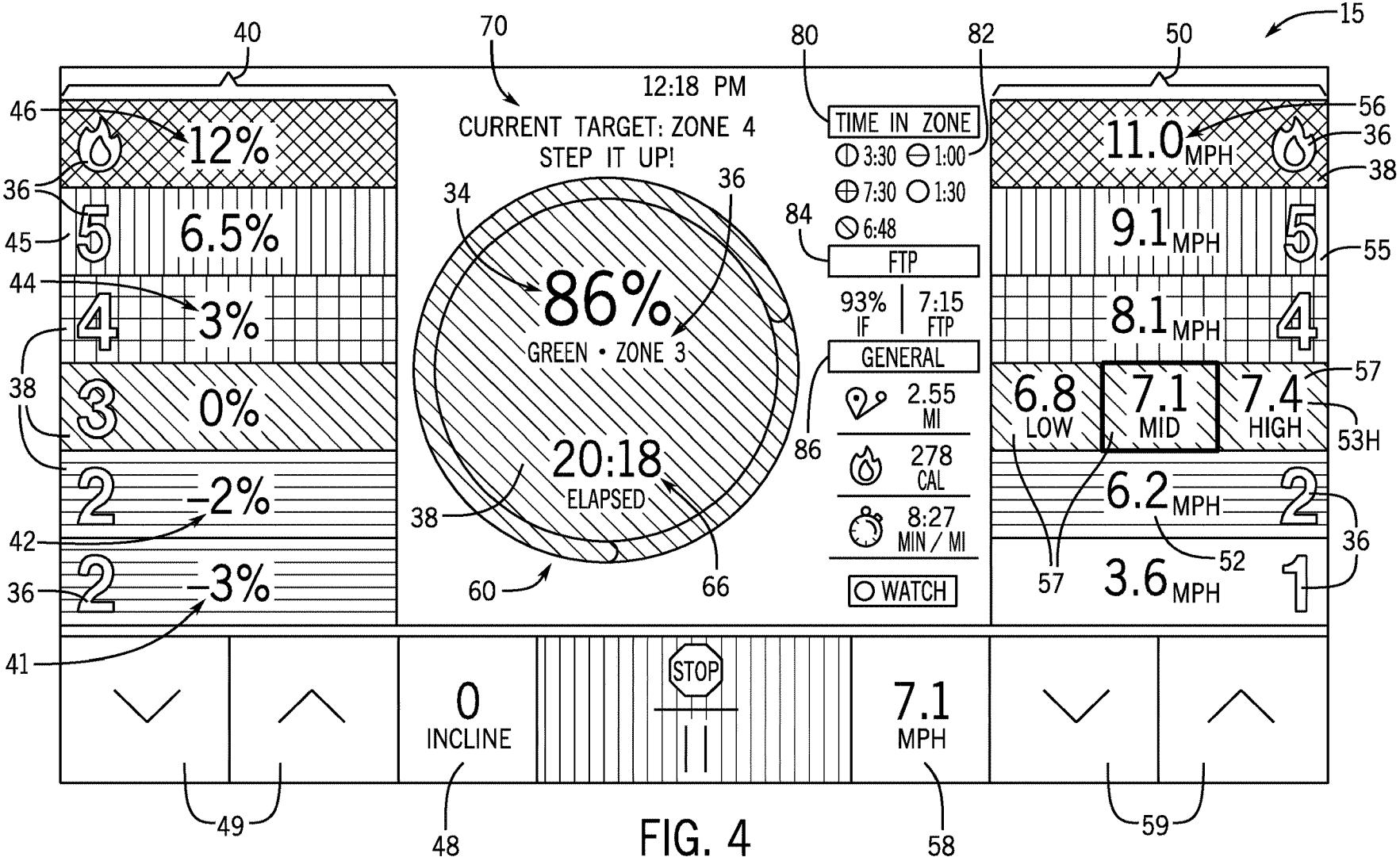
FIGS. 4 and 5 depict exemplary interfaces integrating the presently disclosed system for controlling fitness machines.
Figure 5:
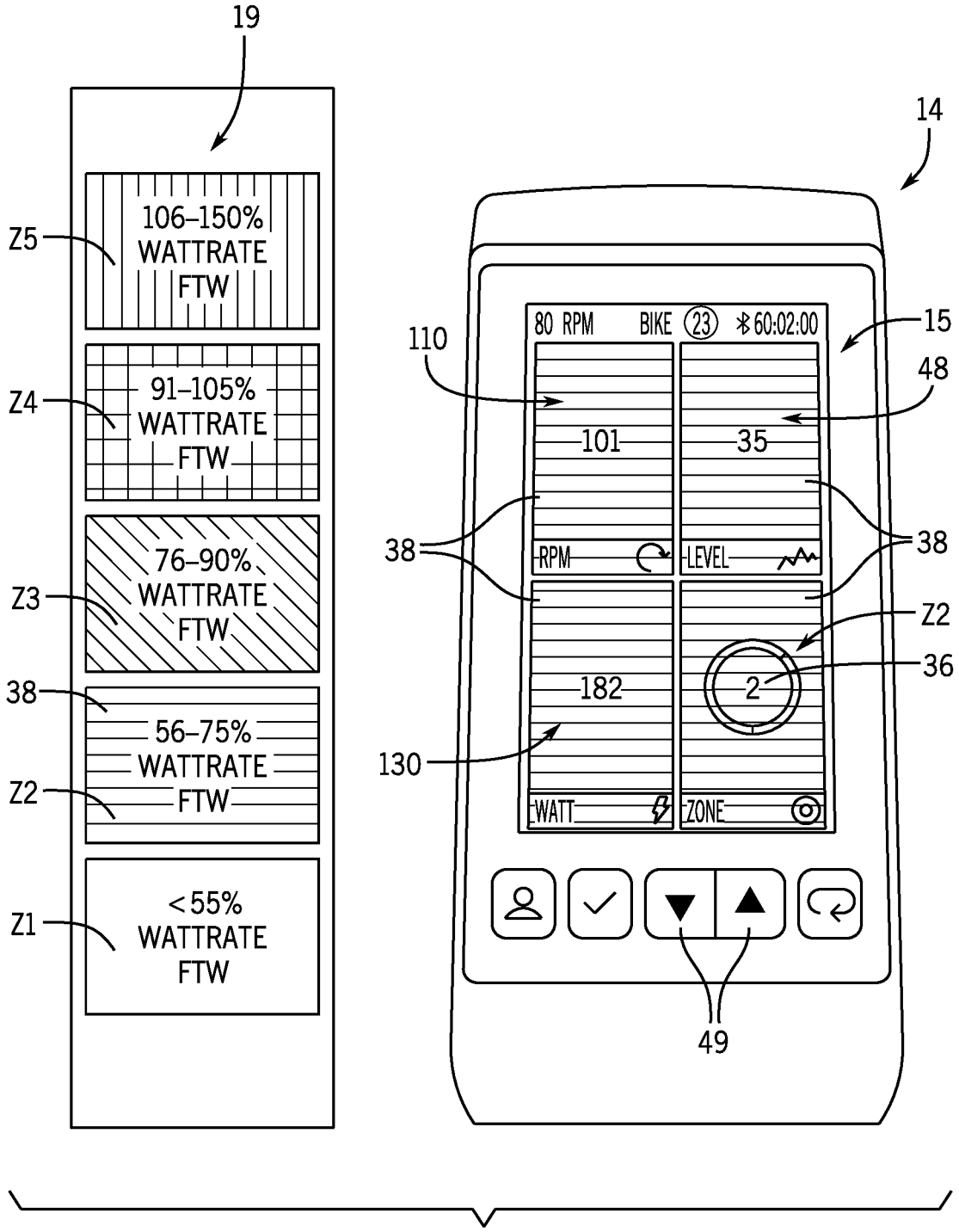

FIGS. 4 and 5 depict exemplary embodiments of interfaces 15 for controlling fitness machines 10 according to the present disclosure. In particular, FIG. 4 depicts an interface 15 in which selections can be made for a first parameter 40 and/or a second parameter 50, such as a treadmill incline and treadmill speed, respectively, for example. In the embodiment shown, the first parameter 40 can be manually selected through the adjustment buttons 49, but also may be selected through quick keys shown as first parameter operating levels 41-46. Each of the first parameter operating levels 41-46 corresponds to a different setting for the first parameter 40, such as a distinct incline angle to set the fitness machine 10. In the example shown, the first first parameter operating level 41 corresponds to an incline angle of −3%, whereas the sixth first parameter operating level 46 corresponds to an incline angle of 12%. In addition to displaying the first parameter operating levels 41-46, the intensity 36 corresponding with each is also displayed such that the user may discern the intensity for operating the fitness machine 10 when selected. In this manner, if a coach were to ask the user to transition to an intensity value 36 from zone 3 Z3 to zone 2 Z2, the user may select the first first parameter operating level 41, or the second first parameter operating level 42, as each corresponds to an intensity rating 36 of zone 2 Z2.

In addition to displaying the intensity rating 36 for each of the first parameter operating levels 41-46, each is also displayed in the corresponding intensity color 38 as previously discussed. This provides the user with a quick mechanism for identifying the intensity associated with each of the options, and transition points between intensity ratings 36. The current value 48 for the first parameter 40 is also shown, presently at an incline of 0.

A set of second parameter operating levels 51-56 corresponding to the second parameter 50 is also provided on the interface 15, which are provided similarly to that described with respect to the first parameter 40. A current value 58 for the second parameter 50 and adjustment buttons 59 for manually selecting among the second parameter 50 options are also provided. In the embodiment shown, the interface 15 further shows the additional feature of displaying sub-operating levels 57 within each of the second parameter operating levels 51-56 (which in certain embodiments are also or alternatively available for first parameter 40 selections as well). In the present embodiments having sub-operating levels 57, selecting one of the second parameter operating levels 51-56, results in displaying of sub-operating levels, shown here as low value 53L, mid value 53M, and high value 53H. In other words, selection of one of the second parameter operating levels 51-56 display a finer group of selections surrounding the second parameter operating level 51-56 previously chosen, for example with the mid value 53M being the same value as the second parameter operating level 51-56 originally chosen, or close thereto. The other values, such as the low value 53L and high value 53H, are provided as distinct selections, but remain between the second parameter operating level 51-56 above and below the one originally chosen. This enables the user to have additional options for quick selection, without cluttering the screen by showing sub-operating levels 57 for second parameter operating levels 51-56 that are not of interest.

In this manner, if a coach were to instruct the user to transition to a new level, such as zone 5 Z5 from zone 3 Z3, the user would immediately be empowered to select the fifth first parameter operating level 45 corresponding to an incline of 6.5%, or the fifth second parameter operating level 55 corresponding to 9.1 miles per hour. The user may also or alternatively make selections from among other first parameter operating levels 41-46 and second parameter operating levels 51-56, whereby a first selection made within either the first parameters 40 or second parameters 50 changes the intensity ratings 36 displayed with the selections available for the other.

The interface 15 further includes a current status region 60 that displays the intensity value 34 for presently operating the fitness machine 10, shown here to be 86% of the user's FTP, along with the corresponding intensity rating 36 and intensity color 38. The current zone time 66 is also shown as an elapsed time for how long the user has been operating within that particular intensity rating 36, shown here to be zone 3 Z3.

In the embodiment shown, a current target 70 is also provided, which particularly in virtual contexts informs the user as to an intensity rating 36 to be targeting (shown here as zone 4), and also provides instruction or motivation for the user (such as "STEP IT UP!"). Additional information may also be shown on the interface 15, such as a time in zone summary 80. In certain embodiments this includes displays of time per zone 82, shown in the intensity color 38 corresponding thereto. Power capacity information 84 is also displayed, as well as general information 86 such as distance traveled and calories burned, for example.

FIG. 5 shows a display device 14 and corresponding interface 15 for another fitness device 10, and particularly one in which only a single first parameter 40 is controllable, (i.e., a rower). In the present embodiment, the interface 15 includes a current value 48 of the first parameter 40 selected, and the corresponding intensity value 36, presently shown as zone 2 Z2. Additional information such as RPM 110 and power output 130 are also shown, whereby in the present embodiment all screens within the interface 15 are shown in the intensity color 38 of the present intensity rating 36 for operating the fitness machine 10. In certain embodiments, effective use of the display device 14 is maximized by providing a separate legend 19, such as a sticker adhered nearby the display device 14, showing the zones Z1-Z5 corresponding to each intensity rating 36. Greater or fewer zones (i.e., fire Z6) are also anticipated as being provided.

Figure 6:
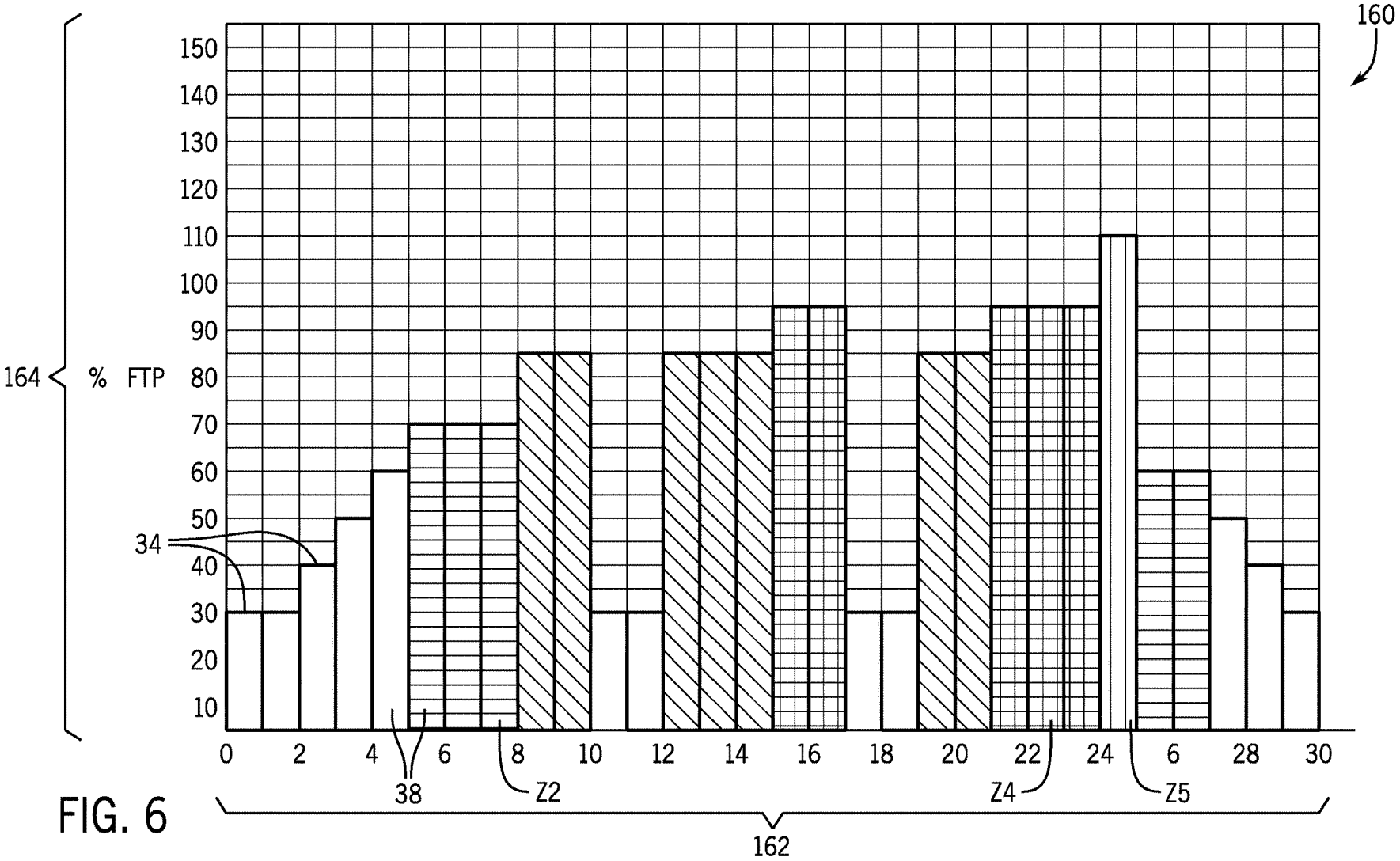
FIG. 6 depicts a chart for performance tracking of a user over time using the system presently disclosed.

FIG. 6 discloses an exemplary performance tracking 160 output for the user following use of the fitness machine 10 according to the present disclosure. The performance tracking 160 includes a chart displaying time 162 versus power capacity 164, whereby the intensity color 38 for each of the bars and intensity value 34 are shown over time. This allows the user to track their performance over a workout, or over time through multiple workouts, for example. The performance tracking 160, as well as control of the system 1 and fitness machine 10 generally, may take place via the display device 14, and/or a separate mobile device paired therewith (i.e., a website or an app on a smart phone).

Figure 7:
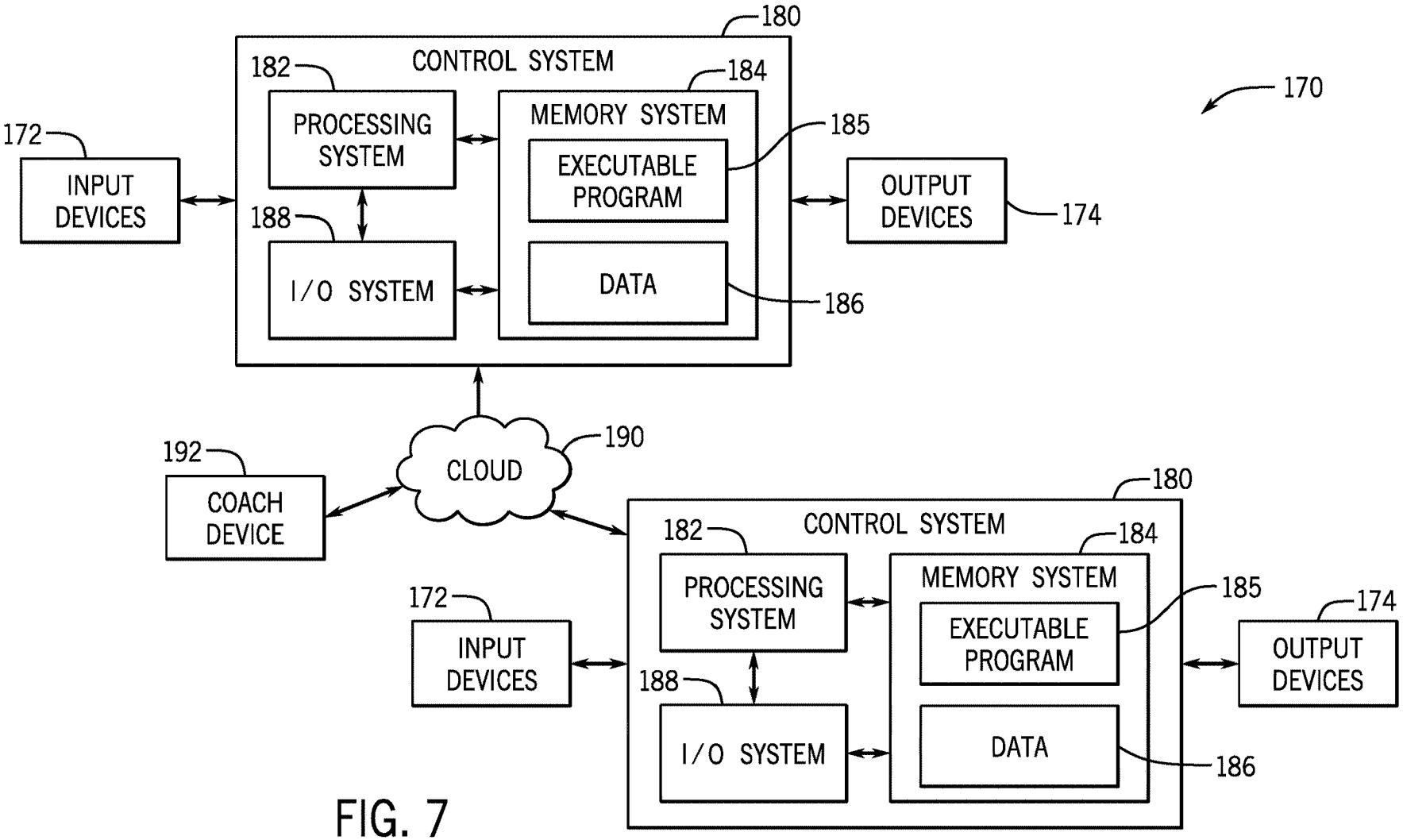
FIG. 7 is a schematic representation of an electronics system for controlling one or more fitness machines according to the present disclosure.

FIG. 7 discloses an exemplary electronics system 170 for controlling and interconnecting one or more fitness machines according to the present disclosure. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

The control system 180 may be a computing system that includes a processing system 182, memory system 184, and input/output (I/O) system 188 for communicating with other devices, such as input devices 172 and output devices 174, which in the present case would both include the display 14 among other devices. The processing system 182 loads and executes an executable program 185 from the memory system 184, accesses data 186 stored within the memory system 184, and directs the system 1 to operate as described in further detail below.

The processing system 182 may be implemented as a single microprocessor or other circuitry, or be distributed across multiple processing devices or sub-systems that cooperate to execute the executable program 185 from the memory system 184 to display the interface 15 and control operation of the fitness machine 10. Non-limiting examples of the processing system include general purpose central processing units, applications specific processors, and logic devices.

The memory system 184 may comprise any storage media readable by the processing system 182 and capable of storing the executable program 185 and/or data 186. The memory system 184 may be implemented as a single storage device, or be distributed across multiple storage devices or sub-systems that cooperate to store computer readable instructions, data structures, program modules, or other data. The memory system 184 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for controlling a fitness machine by a user, the method comprising the steps of:

storing intensity ratings within a memory device, wherein the intensity ratings correspond to an intensity for the user operating the fitness machine;

displaying first parameter operating levels selectable to control the fitness machine, wherein the intensity for the user varies for each of the first parameter operating levels;

displaying second parameter operating levels selectable to control the fitness machine, wherein the intensity for the user varies for each of the second parameter operating levels;

determining and displaying the intensity ratings associated with each of the first parameter operating levels and each of the second parameter operating levels; and receiving selections for the first parameter operating levels and the second parameter operating levels and automatically controlling the fitness machine to operate according thereto, wherein selecting one of the first parameter operating levels changes at least one of the intensity ratings displayed with the second parameter operating levels.

2. The method according to claim 1, wherein selecting one of the second parameter operating levels changes at least one of the intensity ratings displayed with the first parameter operating levels.

3. The method according to claim 1, wherein the first parameter operating levels correspond to resistance levels for operating the fitness machine.

4. The method according to claim 1, wherein the fitness machine is a treadmill and the second parameter operating levels correspond to speeds for operating the treadmill.

5. The method according to claim 1, wherein the intensity is an estimated power required by the user to operate the fitness machine.

6. The method according to claim 5, further comprising determining a power capacity for the user and determining the intensity ratings based on the intensity required by the user to operate the fitness machine relative to the power capacity of the user.

7. The method according to claim 6, wherein the power capacity for the user is a functional threshold power determined for the user.

8. The method according to claim 1, further comprising assigning an intensity color to each of the intensity ratings, and further comprising displaying the intensity color for at least one of the intensity ratings being displayed.

9. The method according to claim 1, further comprising displaying a present intensity rating based on the selections among the first parameter operating levels and the second parameter operating levels.

10. The method according to claim 9, further comprising assigning an intensity color to each of the intensity ratings, and further comprising displaying the intensity color associated with the present intensity rating along with the present intensity rating.

11. The method according to claim 9, further comprising counting a time for which the fitness machine is operated at each of the intensity ratings, and further comprising displaying the time counted for at least one of the intensity ratings.

12. The method according to claim 1, further comprising, upon selecting one of the second parameter operating levels, displaying sub-operating levels selectable for controlling the fitness machine that are each distinct from others within the second parameter operating levels.

13. The method according to claim 12, wherein the sub-operating levels include a low level in which the intensity is less than the selected one of the second parameter operating levels, but greater than each of the others of the second parameter operating levels having intensities less than the selected one of the second parameter operating levels.

14. The method according to claim 1, further comprising providing a target intensity rating for the user, and displaying a recommendation that the user makes a different selection of at least one of the first parameter operating levels and the second parameter operating levels such that the corresponding intensity rating is equal to the target intensity rating.

15. The method according to claim 14, wherein the target intensity rating is provided via a program that includes a plurality of target intensity ratings in a set sequence and set durations.

16. The method according to claim 1, wherein the first parameter operating levels and the second parameter operating levels are selectable only by the user.

17. The method according to claim 1, further comprising determining the first parameter operating levels available for selection to be displayed such that the intensity ratings corresponding thereto include values above and below the intensity rating of the selected one of the first parameter operating levels.

18. A fitness machine controlled according to the method of claim 1.

19. A non-transitory medium having instructions thereon that, when executed by a processing device, causes a fitness machine operated by a user to:

determine intensity ratings corresponding to an intensity for the user operating the fitness machine;

display first parameter operating levels selectable by the user, wherein the processing device causes the fitness machine to operate based on which of the first parameter operating levels is selected and the intensity for the user varies therewith, and wherein the intensity rating associated with each of the first parameter operating levels is displayed; and display second parameter operating levels selectable by the user, wherein the processing device causes the fitness machine to operate based on which of the second parameter operating levels is selected and the intensity for the user varies therewith, and wherein the intensity rating associated with each of the second parameter operating levels is displayed;

wherein selecting among the first parameter operating levels changes the intensity rating displayed with at least one of the second parameter operating levels selectable by the user.

* * * * *